United States Patent [19]

Fatula

[11] Patent Number: 4,580,367

[45] Date of Patent: Apr. 8, 1986

[54] ABRADING APPARATUS

[76] Inventor: James J. Fatula, P.O. Box 272, 523 Spring Ave., Ellwood City, Pa. 16117

[21] Appl. No.: 648,817

[22] Filed: Sep. 10, 1984

[51] Int. Cl.[4] ..... B24B 21/16

[52] U.S. Cl. ..... 51/144; 51/95 WH; 51/123 R; 51/232; 51/100 R

[58] Field of Search ..... 51/95 R, 95 WH, 100 R, 51/101 R, 101 LG, 123 R, 144, 232

[56] References Cited

U.S. PATENT DOCUMENTS

| | | | |
|---|---|---|---|
| 2,656,651 | 10/1953 | Seyferth | 51/144 |
| 2,783,531 | 3/1957 | Eisler | 51/232 X |
| 3,331,164 | 7/1967 | Winer | 51/144 |
| 3,483,660 | 12/1969 | Harris | 51/95 R X |
| 4,077,302 | 3/1978 | Staebler | 51/101 R X |
| 4,195,445 | 4/1980 | Bardonnet | 51/101 LG |
| 4,468,891 | 9/1984 | Giebmanns | 51/95 WH |
| 4,481,740 | 11/1984 | Ballarini | 51/100 R |

*Primary Examiner*—Robert P. Olszewski

[57] ABSTRACT

Apparatus for grinding irregular surfaces of a workpiece includes a frame, a slide movable longitudinally on this frame, a shaft mounted for rotation on the slide and having a workholder mounted on it, a grinder adapted to contact the surface to be ground, and gearing operable by movement of the slide to cause the shaft to simultaneously rotate and move longitudinally to bring the surface to be ground into contact with the grinder. The frame is slidably movable on a base which supports a cam in contact with a cam follower on the shaft so as to move the workholder away from the grinder when there is a gap in the surface to be ground.

7 Claims, 4 Drawing Figures

II
II
WO
W
WC
2
4
6
8
10
12
14
16
22
24
25
26
27
28
30
32
34
36
38
40
44
46

46
WC
44
22
W
20
14
10
41
16
12
6
4
18
8
25
24
2
27
36
38
40
42
28
30
32
34
WO

ABRADING APPARATUS

BACKGROUND OF THE INVENTION

This invention relates to abrading apparatus and more particularly to apparatus for removing irregularities such as flash from arcuate surfaces. It is especially adapted to finish the ends of forged steel wrenches. The ends may be open end sockets or closed sockets which may have a generally circular outer periphery and an inner periphery shaped to grasp the workpiece. In either case there is a reverse bend connecting the arcuate outer surface of the socket to the connecting arm of the wrench. It is necessary to remove the flash and smooth the surface of the socket and reverse bend. Ths usual way of doing this is by means of hand grinding. This requires very high skill on the part of the operator and he is very highly paid. Even though highly skilled the operator cannot do a perfect job. In some cases, especially with small wrenches, the finished socket wall will have a non-uniform thickness and in some cases a portion of the wall will be so reduced in thickness that the life of the wrench is short. The appearance of the surface is often such that some customers will not buy the wrench. Thus it is a costly and unsatisfactory process. In order to eliminate some of the hand work it has been suggested, and sometimes used, to assemble several wrenches together and by relative motion between the outer part of the sockets and a belt grinder to remove the flash from the outer end portion of the socket. However, hand work is still required to grind at least the reverse bend of the wrench. Apparently this method is not satisfactory since it is seldom used.

It is therefore an object of my invention to provide abrading apparatus which can remove flash and smooth the surface of a workpiece of an irregular shape without the use of hand grinding.

BRIEF DESCRIPTION OF THE DRAWINGS

This and other objects will be more apparent after referring to the following specification and attached drawings in which.

DETAILED DESCRIPTION OF THE DRAWINGS

Figure 1:
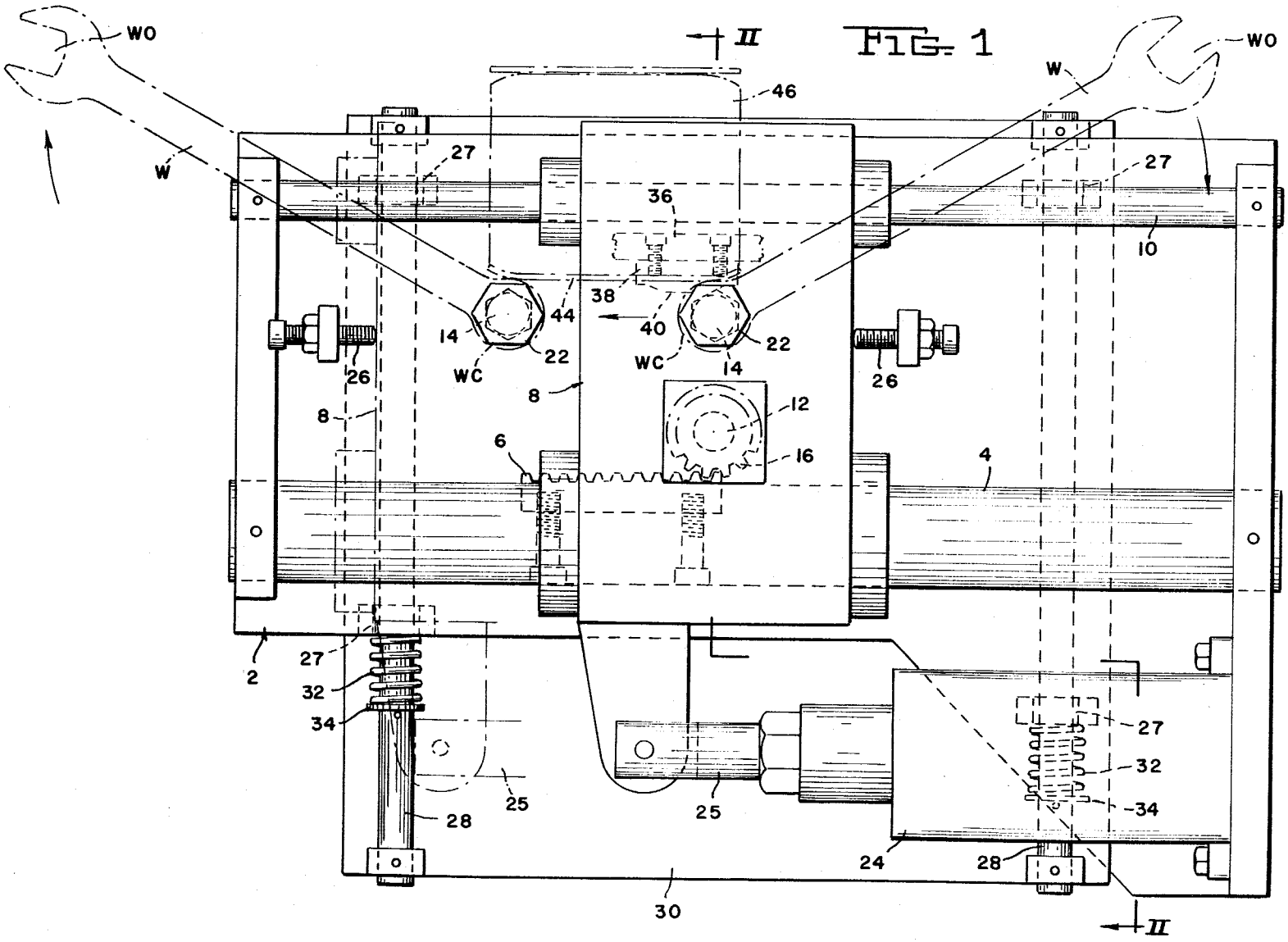
FIG. 1 is a plan view of the apparatus of the invention.
Figures 2, 3, 4:
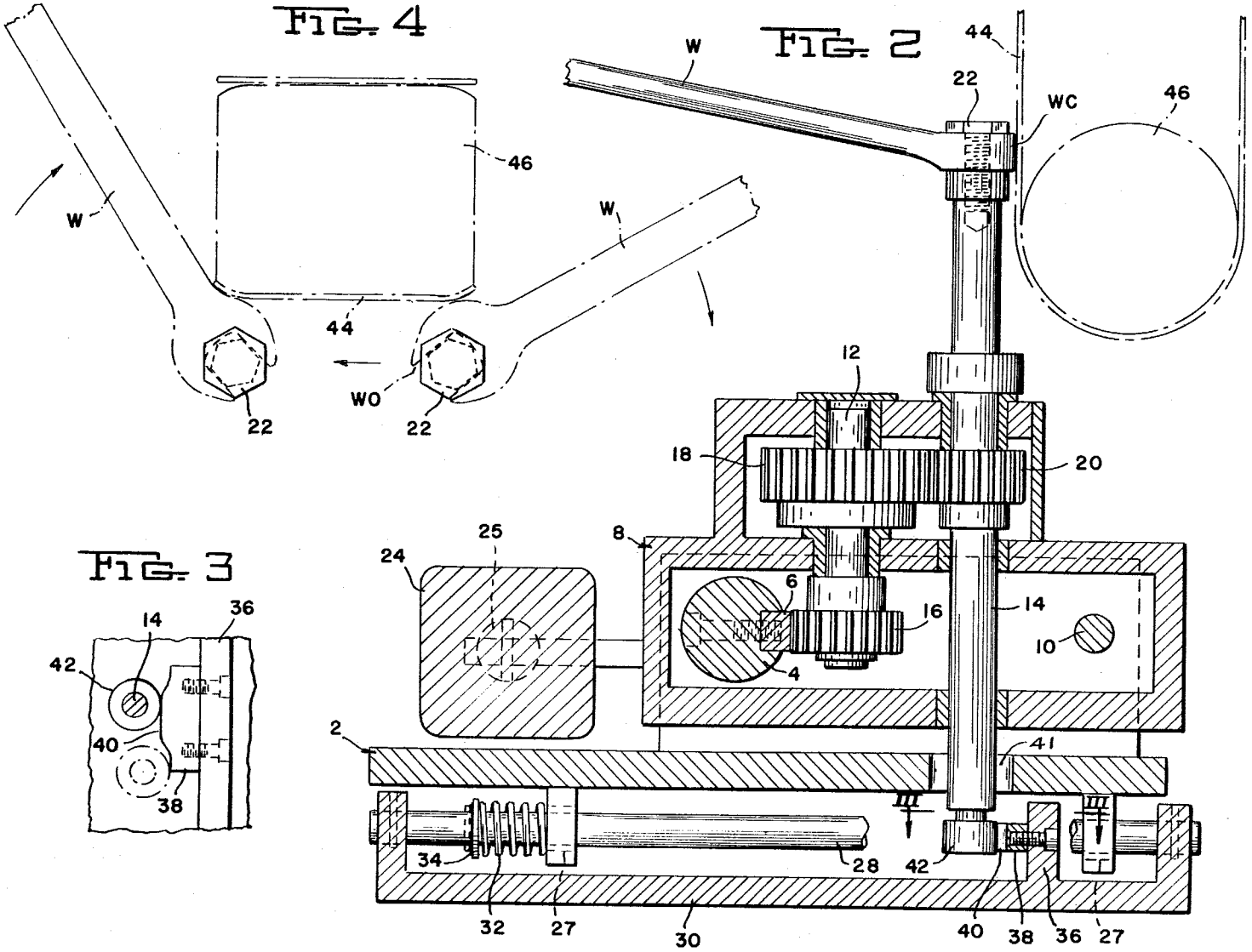
FIG. 2 is a view taken on line II-II of FIG. 1.
FIG. 3 is a view taken on line III-III of FIG. 2.
FIG. 4 is a view showing the positions of a workpiece at the beginning and end of a grinding operation.

Referring more particularly to FIGS. 1 and 2 of the drawings reference numeral 2 indicates a frame on which is supported a stationary rod 4 having a horizontal rack 6 mounted thereon. A housing or slide 8 is slidably mounted on rods 4 and 10 carried by the frame 2. Parallel vertical shafts 12 and 14 are supported in housing 8. Gear 16 is secured to the lower part of shaft 12 and is in mesh with rack 6. Secured to the top of shaft 12 is a gear 18 which is in mesh with a gear 20 secured to shaft 14. A workholder 22 is secured to the top of shaft 14 above the housing 8. A double acting air cylinder 24 having one end secured to frame 2 and its rod 25 secured to slide 8 causes movement of the slide 8 longitudinally of rack 6. This movement causes rotation of shafts 12 and 14 so that the workholder 22 both rotates and moves horizontally at the same time.

Preferably, a pair of adjustable stops 26 are mounted on frame 2 in any suitable manner to control the limit of movement of slide 8.

In order to best grind open end sockets or other workpieces having a gap in the surface to be ground, the frame 2 is mounted by means of bearings 27 attached thereto for transverse slidable movement on a pair of parallel horizontal rods 28 on a base 30. A spring 32 surrounds each rod 28 with one end bearing against a plate 34 secured on the rod and the other end bearing against the left side bearing 27 so as to resiliently urge the frame 2 and slide 8 to the right as shown in FIG. 2. As shown in FIGS. 2 and 3 a bracket 36 attached to base 30 has a cam 38 detachably secured thereto. The cam 38 has a high surface 40 intermediate its ends. The shaft 14 extends downwardly through an elongated slot 41 in frame 2 and has a cam follower 42 mounted on its bottom. The apparatus of this paragraph need not be provided when grinding closed sockets.

An abrading device such as an abrasive belt 44 forming part of a standard belt grinder is positioned adjacent the toolholder 22 so as to grind a workpiece W which is shown as a wrench having a closed socket WC at one end and an open socket WO at the other end. It will be seen that the belt 44 passes around a roll 46 which may be adjustable vertically.

In operation when it is desired to grind closed socket WC the cam 38 is removed or replaced with a straight cam. The wrench W is positioned with its closed socket WC held on holder 22. The cylinder 24 is activated to move the slide 8 longitudinally so that wrench W will move in a path such that the belt 44 will grind the outer surface of socket WC completely including the reverse bend. The spring 32 which may be replaced by other resilient means holds the workpiece firmly gainst the belt 44 while permitting outward movement if the abrading pressure becomes too great because of abnormal irregularities in the surface being ground. In FIG. 1 the position of the wrench W is shown both at the start and finish of the grinding operation.

To grind the open end socket WO that end is placed on workholder 22, and the cam 38 is placed in position. Cylinder 24 is again activated and the grinding will take place as before except that cam surface 40 will cause the slide 8 and wrench to move away from belt 44 when the open portion of socket WO approaches the belt. FIG. 4 shows the position of wrench W at the start and finish of this grinding operation.

It will be understood that the apparatus provides a fixed relationship between the longitudinal and rotary movements by means causing simultaneous rotational and longitudinal movement of the workpeice. The length of travel of the surface to be ground may be varied by changing the position of stops 26. When there is a great deal of difference in the contour of the surface to be ground the fixed relationship between the longitudinal and rotary movements may be changed by changing the diameters of gears 18 and 20. Other means may be used in place of the gears such as sprockets and chain. If adjustability is not desired the shaft 14 can be driven directly from rack 6.

It will be further understood that it may be desired to use abrading belts having different grit fineness to obtain the best surface finish. This may be done by having a plurality of work stations mounted on an indexing member to bring the workpiece successively in contact with belt grinders arranged in sequence so that the workpiece is ground successively to the desired finish.

While two embodiments of my invention have been shown and described it will be understood that other adaptations and modifications may be made within the scope of the following claims.

I claim:

1. Apparatus for grinding irregular surfaces on a workpiece which comprises a supporting frame, a slide movable longitudinally on said frame, a shaft mounted for rotation on said slide transverse to the direction of slide movement and having an end extending from said slide, a workpiece holder mounted on the extended end of said shaft, a belt grinder mounted adjacent said workpiece holder with the belt grinding surface being substantially parallel to the axis of said shaft in position to contact the surface to be ground, means for moving said slide longitudinally, and means operable by movement of said slide to cause said shaft and workholder to simultaneously rotate through an angle greater than 180° and move longitudinally so as to bring the surface to be ground into contact with said grinding surface.

2. Apparatus according to claim 1 for grinding a workpiece having a gap between portions of the surface to be ground which includes means operable during the grinding operation to increase the perpendicular distance between said belt grinding surface and said workholder and subsequently to decrease said perpendicular distance after passing said gap.

3. Apparatus according to claim 2 in which said means operable intermediate the grinding operation includes a base, means mounting said frame on said base for transverse slidable movement, a cam follower mounted on said shaft on the end remote from said workholder, a cam mounted on said base having a high surface intermediate its length for moving said workholder away from said grinding surface, and means moving said workholder to bring the workpiece into engagement with said grinding surface when the cam follower leaves said high surface.

4. Apparatus for grinding irregular surfaces on a workpiece which comprises a supporting frame, a slide movable longitudinally on said frame, a rack mounted longitudinally on said frame, a first shaft mounted for rotation on said slide transversely thereto, a first gear secured to said shaft in mesh with said rack, a second shaft mounted for rotation on said slide parallel to said first shaft and having an end extending from said slide, means connecting said shafts to cause said second shaft to rotate with said first shaft, a workholder mounted on the extended end of said second shaft, a belt grinder mounted adjacent said workholder with the belt grinding surface being substantially parallel to the axis of said second shaft in position to contact the surface to be ground, means for moving said slide longitudinally to cause said shaft and workholder to simultaneously rotate through an angle greater than 180° and move longitudinally so as to bring the surface to be ground into contact with said grinding surface.

5. Apparatus according to claim 4 for grinding a workpiece having a gap between portions of the surface to be ground which includes means operable during the grinding operation to increase the perpendicular distance between said belt grinding surface and said workholder and subsequently to decrease said perpendicular distance after passing said gap.

6. Apparatus according to claim 5 in which said means connecting said shafts includes a second gear on said first shaft, and a gear on said second shaft in mesh with said second gear.

7. Apparatus according to claim 5 in which said means operable intermediate the grinding operation includes a base, means mounting said frame on said base for transverse slidable movement, a cam follower mounted on said second shaft on the end remote from said workholder, a cam mounted on said base having a high surface intermediate its length for moving said workholder away from said grinding surface, and means moving said workholder to bring the workpiece into engagement with said grinding surface when the cam follower leaves said high surface.

* * * * *